US007698919B2

(12) United States Patent
Kim

(10) Patent No.: US 7,698,919 B2
(45) Date of Patent: Apr. 20, 2010

(54) LOCKING DEVICE

(76) Inventor: Gab-Sik Kim, 5F Samyang Building, 107-12 Karak-dong, Songpa-ku, Seoul, 138-160 (KR)

( * ) Notice: Subject to any disclaimer, the term of this patent is extended or adjusted under 35 U.S.C. 154(b) by 174 days.

(21) Appl. No.: 11/918,044

(22) PCT Filed: Apr. 5, 2006

(86) PCT No.: PCT/KR2006/001247

§ 371 (c)(1),
(2), (4) Date: Oct. 9, 2007

(87) PCT Pub. No.: WO2006/115337

PCT Pub. Date: Nov. 2, 2006

(65) Prior Publication Data

US 2009/0038354 A1 Feb. 12, 2009

(51) Int. Cl.
*E05B 47/00* (2006.01)

(52) U.S. Cl. ..... 70/280; 70/277; 70/283; 70/472

(58) Field of Classification Search ..... 70/280–283, 70/283.1, 278.1, 278.2, 278.3, 277, 375, 70/472

See application file for complete search history.

(56) References Cited

U.S. PATENT DOCUMENTS 3,748,878 A * 7/1973 Balzano et al. ..... 70/218
3,939,679 A * 2/1976 Barker et al. ..... 70/277
4,671,087 A * 6/1987 Olenfalk et al. ..... 70/283
4,736,970 A * 4/1988 McGourty et al. ..... 292/359
5,018,375 A * 5/1991 Tully ..... 70/472
5,421,178 A * 6/1995 Hamel et al. ..... 70/283
5,473,922 A * 12/1995 Bair et al. ..... 70/416
5,542,274 A * 8/1996 Thordmark et al. ..... 70/495
5,694,798 A * 12/1997 Nunez et al. ..... 70/283
5,839,307 A * 11/1998 Field et al. ..... 70/283
5,931,430 A * 8/1999 Palmer ..... 248/311.2
6,038,896 A * 3/2000 Chamberlain et al. ..... 70/279.1
6,094,952 A * 8/2000 Clark et al. ..... 70/278.1
6,196,037 B1 * 3/2001 Urschel et al. ..... 70/416
6,212,923 B1 * 4/2001 Clark ..... 70/416
6,564,601 B2 * 5/2003 Hyatt, Jr. ..... 70/278.3
6,826,935 B2 * 12/2004 Gokcebay et al. ..... 70/278.3
6,845,642 B2 * 1/2005 Imedio Ocana ..... 70/277
6,865,916 B2 * 3/2005 Goldman ..... 70/472
7,007,526 B2 * 3/2006 Frolov et al. ..... 70/277

(Continued)

FOREIGN PATENT DOCUMENTS

KR 2004-0107356 A 12/2004

*Primary Examiner*—Suzanne D Barrett
(74) *Attorney, Agent, or Firm*—Birch, Stewart, Kolasch & Birch, LLP

(57) ABSTRACT

Disclosed is a locking device which comprises a housing, and a cylinder device rotating within the housing, wherein the housing is provided with a protrusion therein to prevent the cylinder device from being rotated, and the cylinder device includes a motor, a cylinder receiving the motor, a tilting mechanism located at the front of the cylinder, having an upper portion tilted to be fixed to the protrusion of the housing by forward rotation of the motor and a recess released from the protrusion of the housing by reverse rotation of the motor, and a locking plate adapter fixed to the tilting mechanism, and a locking plate fixed to the adapter.

5 Claims, 8 Drawing Sheets

U.S. PATENT DOCUMENTS 7,222,508 B2 * 5/2007 Dickhans et al. ..... 70/279.1
2004/0177660 A1 * 9/2004 Tsai ..... 70/223
2004/0250578 A1 * 12/2004 Sakai ..... 70/277
2008/0078220 A1 * 4/2008 Kim ..... 70/283.1

* cited by examiner

LOCKING DEVICE

TECHNICAL FIELD

The present invention relates to a locking device, and more particularly, to a locking device in which rotational driving of a cylinder device is controlled by a motor.

BACKGROUND ART

A locking device is designed in such a manner that a locking plate connected with a cylinder device is rotatably opened and closed after a key is inserted into the cylinder device to rotate the cylinder device.

A locking plate of a general locking device is mechanically connected with a cylinder device.

However, such a structure that the locking plate is mechanically connected with the cylinder device has limitation in ensuring safety essential to the locking device. Most of the locking devices are designed in such a manner that a key having no approval cannot be inserted into a cylinder device or the cylinder device cannot be rotated even if such a key is inserted into the cylinder device. However, if the cylinder device is once rotated, the locking plate is driven to open the locking device. Therefore, people who illegally try to open the locking device are likely to insert the key or another similar tool into the cylinder device to rotate the cylinder device. And, if the cylinder device is once rotated, the locking device is opened. In another case, people may drive the locking plate by destroying the cylinder device.

DISCLOSURE OF INVENTION

Technical Problem

The present invention has been made to solve the above-mentioned problems occurring in the prior art, and an object of the present invention is to provide a locking device in which a cylinder device cannot be rotated by an illegal method.

Another object of the present invention is to provide a locking device in which a locking plate is not driven unless a cylinder device is rotated.

Other object of the present invention is to provide a locking device in which a locking plate is not driven even if a cylinder device is destroyed.

Technical Solution

To achieve the objects of the present invention, a locking device comprises a housing, and a cylinder device rotating within the housing, wherein the housing is provided with a protrusion therein to prevent the cylinder device from being rotated, and the cylinder device includes a motor, a cylinder receiving the motor, a tilting mechanism located at the front of the cylinder, having an upper portion tilted to be fixed to the protrusion of the housing by forward rotation of the motor and a recess released from the protrusion of the housing by reverse rotation of the motor, and a locking plate adapter fixed to the tilting mechanism, and a locking plate fixed to the adapter.

In the present invention, if the motor is rotated in a forward direction, the upper portion of the tilting mechanism is tilted to fix the recess formed at the upper portion of the tilting mechanism to the protrusion of the housing, whereby the cylinder device cannot be rotated. If the motor is rotated in a reverse direction, the tilted tilting mechanism is erected to release the recess formed at the upper portion of the tilting mechanism from the protrusion of the housing, whereby the cylinder device can be rotated.

In the present invention, the motor is constructed to be driven when a code stored in a ROM of a key is identical with a code of EEPROM provided in the locking device. With respect to this structure, the technology of the Korean Patent Publication No. 2001-0001556 titled Electronic Lock System invented by the inventor of this invention could be used.

ROM keys used in the lock system disclosed in the Korean Patent Publication No. 2001-0001556 have unique electronic codes that cannot be deleted or changed. Keys having ROM with such electronic codes (referred to as ROM keys) are stored in EEPROM of the system through an input terminal and perform their specific function when the electronic codes identified with those stored in the EEPROM are input.

Therefore, the ROM keys have different functions depending on which electronic codes of the ROM keys are stored in the EEPROM of the system. The ROM keys having the electronic codes stored in the EEPROM of the system with the same function have the same function as one another. It is therefore desirable that a memory area of the EEPROM is divided into parts to allow the electronic codes having the same function to be stored in a corresponding part.

In other words, ROM keys having electronic codes stored in one area perform the same function but those having electronic codes stored in different areas perform different functions. Such ROM keys are provided at various levels. For example, a ROM key of high level controls a ROM key of low level. That is, a ROM key of the first level, i.e., the highest level, stores an electronic code of a specific ROM key in the EEPROM of the system so that the electronic code is used as a ROM key of the second level. Alternatively, the ROM key of the first level is used to delete the electronic code of the specific ROM key and change the electronic code of the ROM key of the first level stored in the EEPROM. Further, the ROM key of the second level stores the electronic codes of the specific ROM keys in the EEPROM so that each electronic code is used as a ROM key of the third level or the fourth level. Alternatively, the ROM key of the second level is used to delete the electronic codes of the specific ROM keys and perform a specific function. Whether the specific ROM key performs the function of the ROM key of the third level or the fourth level depends on that the electronic code of the specific ROM key has been stored in the EEPROM with which function of the ROM key of the second level. The ROM key of the third level stores the electronic code of the specific ROM key in the EEPROM so that it functions as the ROM key of the fourth level.

An electronic code of another ROM key previously stored in the EEPROM could be stored in the EEPROM or deleted from the EEPROM by controlling an ALU after inputting the electronic code of the ROM key previously stored in the EEPROM to RAM through an input terminal.

As described above, the electronic code of the ROM key previously stored in the EEPROM could be stored or deleted from a specific area when the ROM key is touched with the input terminal to allow the electronic code of the ROM key to be input to the RAM through the input terminal and the ALU identifies the electronic code.

ADVANTAGEOUS EFFECTS

In the locking device according to the present invention, a cylinder cannot be rotated and a locking plate cannot be operated by an illegal method. Also, even though the cylinder is destroyed, the locking plate cannot be operated.

BRIEF DESCRIPTION OF THE DRAWINGS

FIG. 1 illustrates a locking device according to the present invention, in which

FIG. 4 illustrates the opened state of a locking device, in which

FIG. 5 illustrates the locked state of a locking device, in which FIG. 6 illustrates the opening operation of a locking device locked, in which

BEST MODE FOR CARRYING OUT THE INVENTION

Hereinafter, a locking device according to the present invention will be described in detail with reference to the accompanying drawings.

Figure 1A:
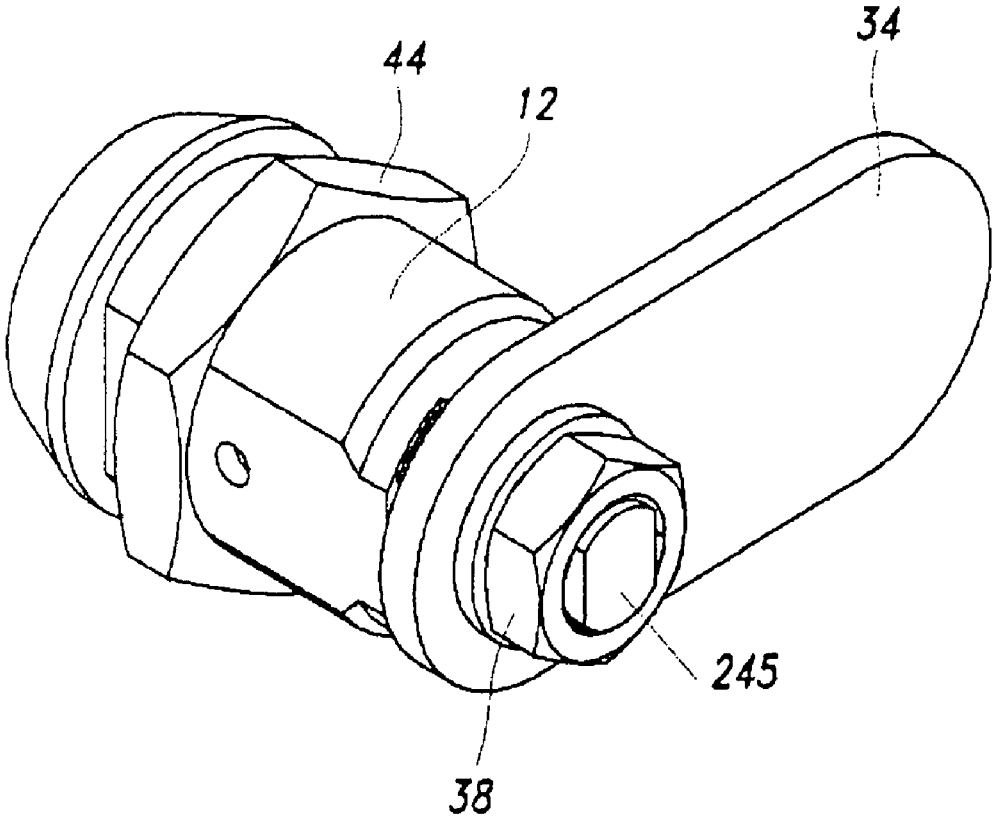
FIG. 1A illustrates the state that a locking device 1 is locked and FIG. 1B illustrates the state that the locking device 1 is opened.
Figure 1B:
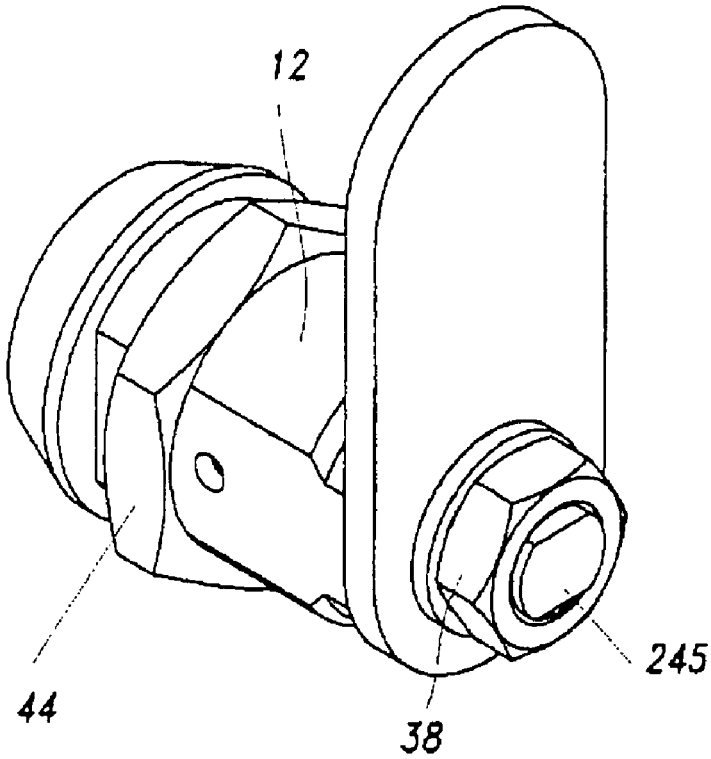

FIG. 1 illustrates a locking device according to the present invention, in which FIG. 1A illustrates the state that a locking device 1 is locked and FIG. 1B illustrates the state that the locking device 1 is opened.

If a key is inserted into a cylinder device in a state that the locking device 1 according to the present invention is locked as shown in FIG. 1A, a motor constituting the cylinder device located in a housing 12 is driven so that the cylinder device can be rotated. In this state, if the key is turned, the cylinder device inside the housing 12 is rotated so that a locking plate 34 connected with a rotary shaft 245 of the cylinder device is rotated to open the locking device. A reference numeral 44 represents a nut for installing the locking device in a drawer of a desk or a door of a closet.

Figure 2:
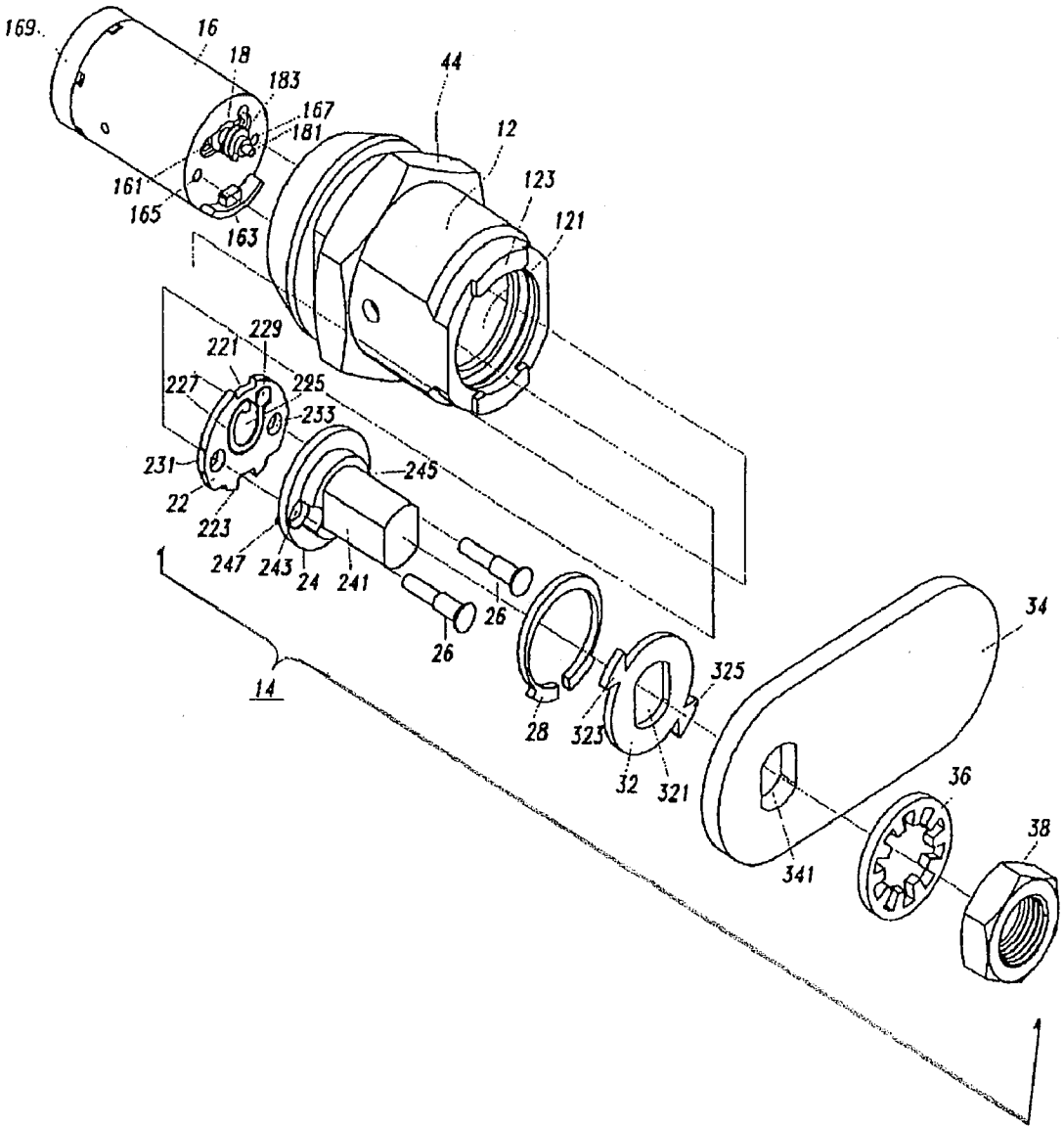
FIG. 2 is an exploded perspective view illustrating a locking device according to the present invention.
Figure 3:
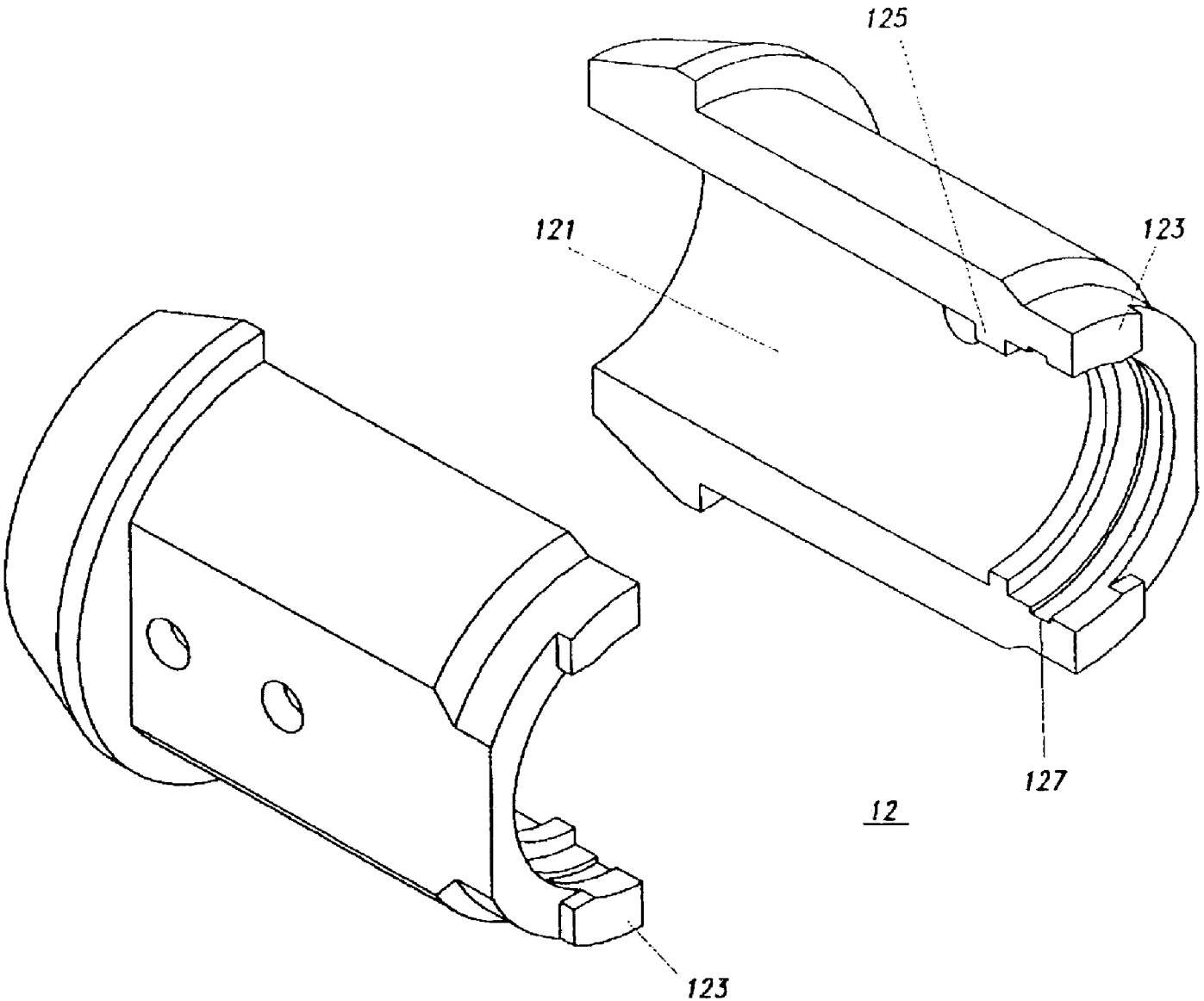
FIG. 3 is a cut perspective view illustrating an inner structure of a housing.

FIG. 2 is an exploded perspective view illustrating the locking device according to the present invention, and FIG. 3 is a cut perspective view illustrating an inner structure of the housing.

Referring to FIGS. 2 and 3, the locking device 1 includes a housing 12 and a cylinder device 14 received in the housing 12. The housing 12 has an inner structure of an empty space 121 of a cylindrical shape opened in front and rear directions to receive the cylinder device 14. The rotary shaft of the cylinder device 14 received in the empty space 121 of the housing 12 is externally exposed through a front opening hole of the housing. The locking plate 34 is fixed to the exposed rotary shaft 245 of the cylinder device 14. The key is fixed to the cylinder device 14 located inside the housing 12 through a rear opening hole to rotate the cylinder device.

The front side of the housing 12 is more protruded than the other sides so that a rotation limiter 123 is provided to limit rotation of the cylinder device. In more detail, the rotation limiter 123 limits a rotational angle range of the cylinder device 14. A snap ring fitting groove 127 is formed inside the housing 12 so as not to detach the cylinder device 14 from the housing 12. A protrusion is formed at the rear of the snap ring fitting groove 127 and constitutes a rotation stopper 125 that stops rotation of the cylinder device 14.

The cylinder device 14 includes a cylinder 16. A motor is received in the cylinder 16. The front side of the cylinder 16 is provided with a motor rotary shaft opening 161 and bolt fitting holes 165 and 167, wherein the motor rotary shaft is extended through the motor rotary shaft opening 161. A motor rotary shaft 181 received in the cylinder 16 is exposed to the outside of the cylinder 16 through the opening 161 formed on the front surface of the cylinder 16.

A worm gear 183 is fixed to the motor rotary shaft 181 exposed to the outside of the cylinder 16. A rotation stopper 163 is protruded at the front of the cylinder 16 to stop rotation of a titling mechanism 22. A key fitting device 169 is fixed to the rear side of the cylinder 16. The key fitting device 169 is constructed to electrically recognize an identification number inside the key and structurally rotate the cylinder device by turning the key. The key fitting device can be manufactured in various structures.

The tilting mechanism 22 is located at the front of the cylinder 16, and an adaptor 24 for the locking plate is located at the front of the tilting mechanism 22.

The tilting mechanism 22 has a substantially circular plate shape, and is provided with recesses 221 and 223 at upper and lower portions and a hole 225 at a center portion. Bolt through holes 231 and 233 are formed at both sides of the hole 225.

The worm gear 183 of the motor rotary shaft 181 exposed to the outside of the cylinder 16 through the opening 161 formed on the front surface of the cylinder 16 passes through the hole 225 of the tilting mechanism 22. A hook shaped plate spring 227 is fixed to the tilting mechanism 22. One end of the hook shaped plate spring 227 is fixed to the tilting mechanism 22 by a screw 229, and its other end is fitted into the worm gear 183 of the rotary shaft 181 located in the hole 225. The rotation stopper 163 formed at the front of the cylinder 16 is fitted into the recess 223 formed at the lower portion of the tilting mechanism 22 to prevent the tilting mechanism 22 from being rotated. Accordingly, if the motor rotates in a forward direction, the hook shaped plate spring 227 advances in a forward direction along the worm gear 183. If the motor rotates in a reverse direction, the hook shaped plate spring 227 is retracted along the worm gear 183. If the plate spring 227 advances in a forward direction along the worm gear 183, the tilting mechanism 22 is tilted toward the right side. If the plate spring 227 is retracted toward the rear side along the worm gear 183, the tilting mechanism 22 is erected. If the tilting mechanism 22 is tilted toward the right side as the plate spring 227 advances in a forward direction along the worm gear 183, the rotation stopper 125 of the housing 12 is fitted into the recess 221 formed at the upper portion of the tilting mechanism 22, thereby preventing the cylinder device from being rotated.

The adapter 24 located at the front of the tilting mechanism 22 is fixed to the housing 12 by a snap ring 28. A boss 241 is protruded at the front of the adapter 24 to fit the locking plate 34 thereinto, and fitting bolt holes 243 and 245 are formed at both sides of the adapter 24.

A fitting bolt 26 is fitted into the fitting holes 165 and 167 through the bolt through holes 243 and 245 of the adapter 24 and the bolt through holes 231 and 233 of the tilting mechanism 22.

If the plate spring 227 advances in a forward direction along the worm gear 183, a tilting edge 247 of the tilting mechanism is formed below the rear side of the adapter 24 more protuberantly than the other sides to allow the tilting mechanism 22 to be tilted toward the right side.

A stopper 32, the locking plate 34, and a washer 36 are securely fitted into the boss 241 of the adapter 24 in due order by a fitting nut 38.

The stopper 32 fitted into the boss 241 is operated along with the rotation limiter 123 of the cylinder device protruded along the front surface of the housing so as to limit a rotation range of the adapter 24.

The operation of the locking device according to the present invention will now be described.

Figure 4A:
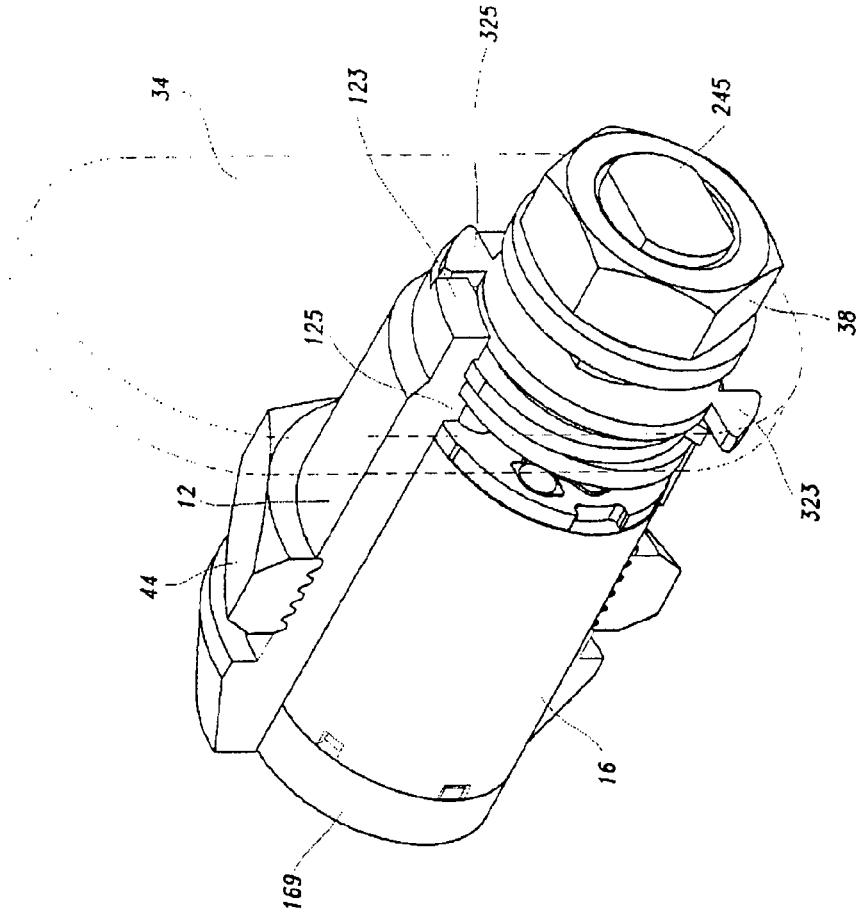
FIG. 4A is a perspective view illustrating a cut inside of a housing in a state that a locking device is opened.
Figure 4B:
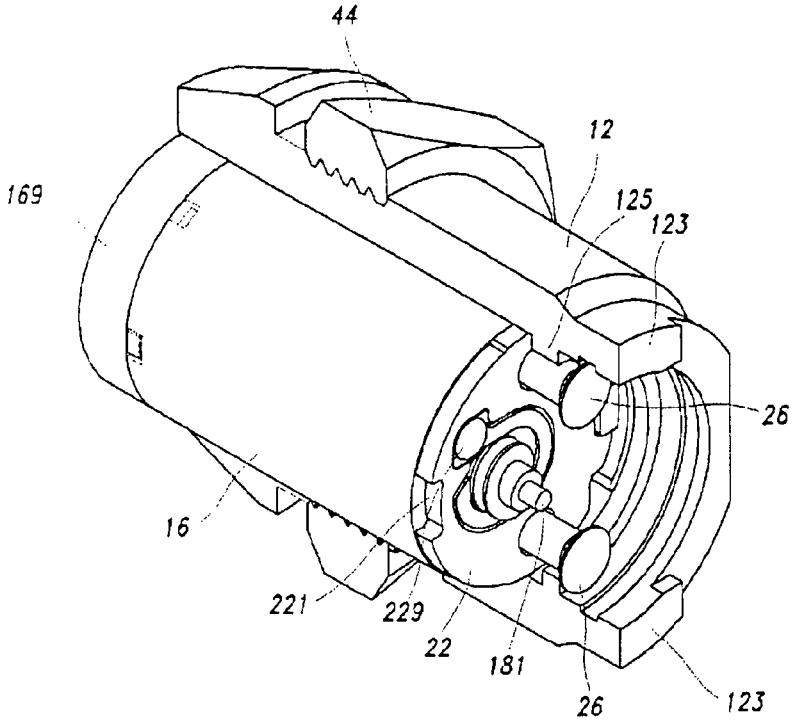
FIG. 4B illustrates relation among a cylinder, a tilting mechanism and a rotation stopper of a housing in a state of FIG. 4A.

FIG. 4 illustrates the opened state of the locking device, in which FIG. 4A is a perspective view illustrating a cut inside of the housing in a state that the locking device is opened, and FIG. 4B illustrates relation among the cylinder 16, the tilting mechanism 22 and the rotation stopper 125 of the housing in the state of FIG. 4A.

Figure 5A:
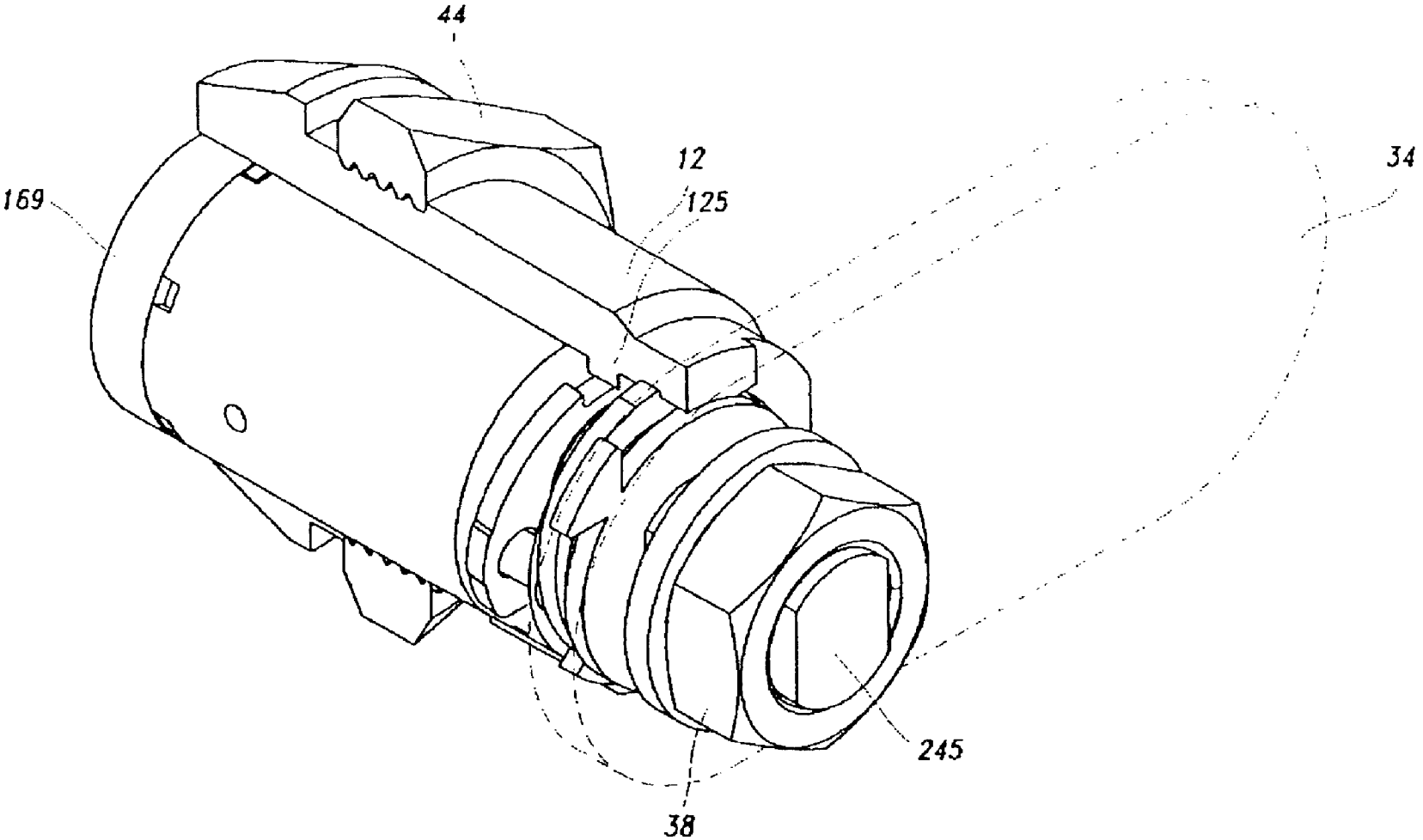
FIG. 5A is a perspective view illustrating a cut inside of a housing in a state that a locking device is locked.
Figure 5B:
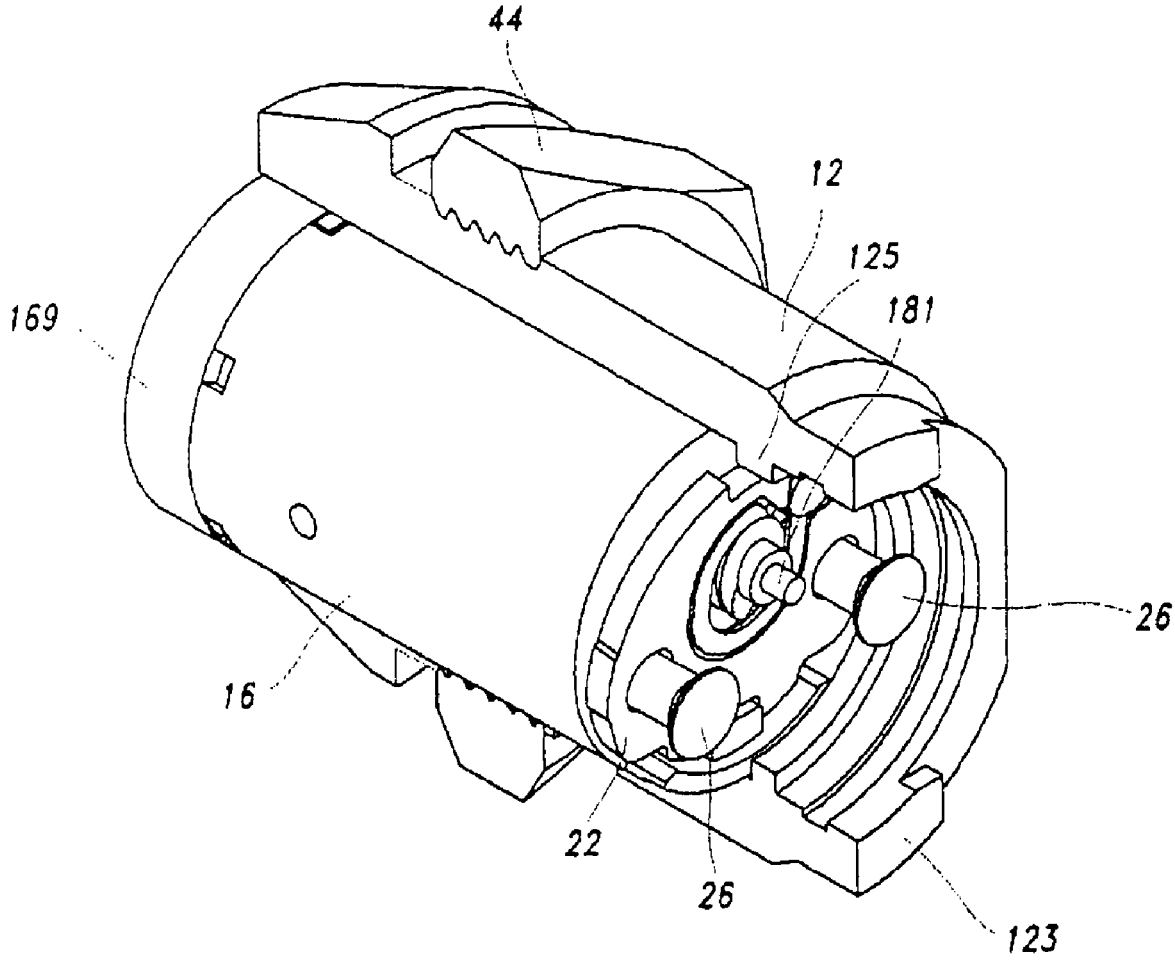
FIG. 5B illustrates relation among a cylinder, a tilting mechanism and a rotation stopper of a housing in a state of FIG. 5A.

FIG. 5 illustrates the locked state of the locking device, in which FIG. 5A is a perspective view illustrating a cut inside of the housing in a state that the locking device is locked, and FIG. 5B illustrates relation among the cylinder 16, the tilting mechanism 22 and the rotation stopper of the housing in the state of FIG. 5A.

Figure 6A:
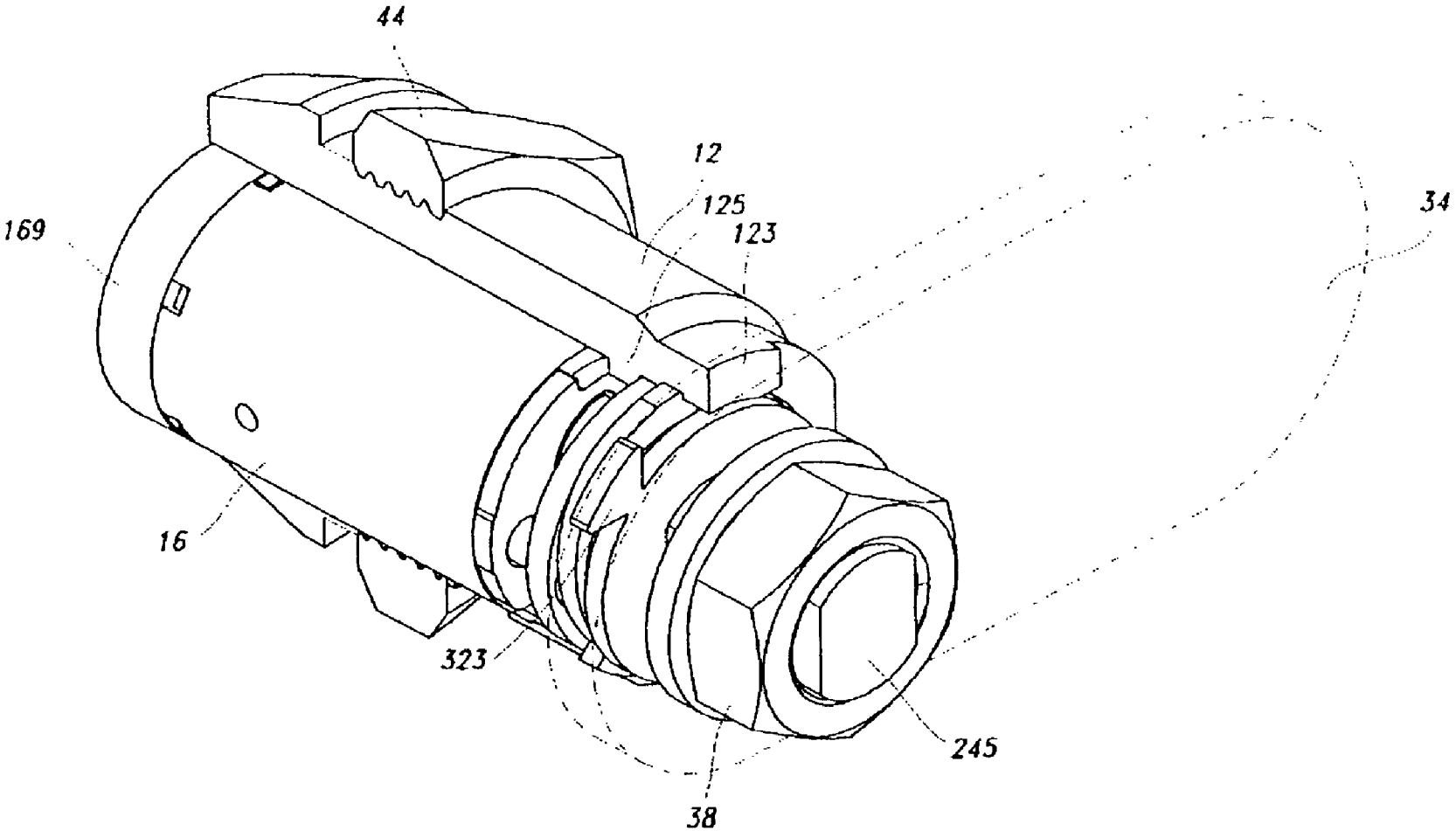
FIG. 6A is a perspective view illustrating a cut inside of a housing in a state that a locking device can be opened.
Figure 6B:
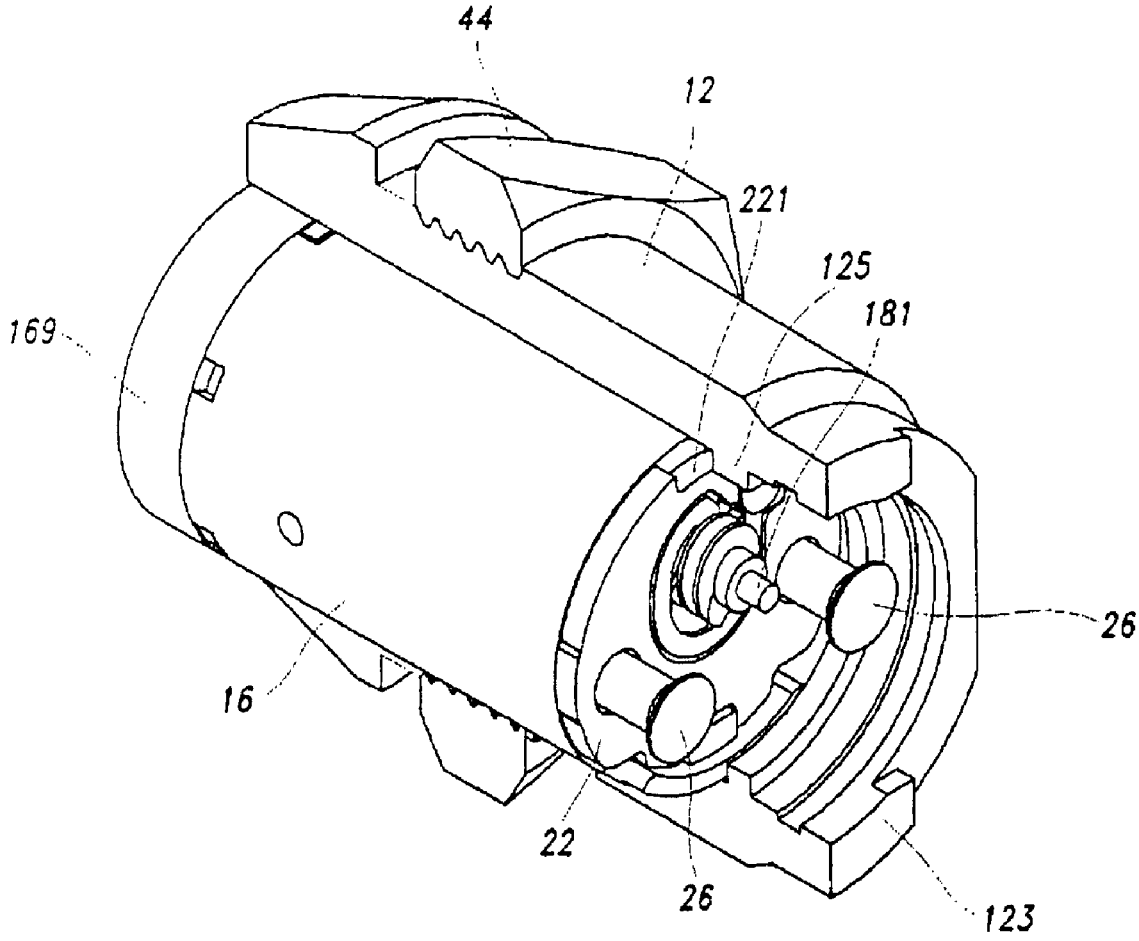
FIG. 6B illustrates relation among a cylinder, a tilting mechanism and a rotation stopper of a housing in a state of FIG. 6A.

FIG. 6 illustrates the opening operation of the locking device locked, in which FIG. 6A is a perspective view illustrating a cut inside of the housing in a state that the locking device can be opened, and FIG. 6B illustrates relation among the cylinder 16, the tilting mechanism 22 and the rotation stopper 125 of the housing in the state of FIG. 6A.

Referring to FIGS. 4A and 4B, in a state that the locking device 1 is opened, the cylinder device is rotated to erect the locking plate 34. At this time, the tilting mechanism 22 is erected from its tilted state retracted toward the cylinder 16, and is rotated so that the recess 221 formed at the upper portion of the tilting mechanism 22 is detached from the rotation stopper 125 of the housing to make a right angle with respect to the rotation stopper 125. Also, since a protrusion 325 formed at the stopper 34 adjoins the rotation stopper 125 of the housing, the cylinder device cannot be rotated any longer.

If the key is inserted into the locking device to lock the opened locking device, the motor 18 located in the cylinder of the housing is rotated in a forward direction. Then, one end of the plate spring 227 advances in a forward direction along the worm gear 183. In this case, the tilting mechanism 22 fixed to the plate spring 227 also advances in a forward direction, wherein the lower portion of the tilting mechanism is tilted by the edge 257 protruded toward the rear side of the adapter 24. In this state, if the cylinder device 14 is rotated by the key, the locking plate is also rotated. At this time, the upper recess 221 of the tilting mechanism 22 is inserted into the rotation stopper 125 of the housing so as not to rotate the cylinder device any longer, whereby the locking device is locked.

FIGS. 5A and 5B illustrate the locking device 1 of the locked state. In the locking device 1 of the locked state, the upper recess 221 of the tilting mechanism 22 is inserted into the rotation stopper 125 of the housing so as not to rotate the cylinder device any longer.

If the key is inserted into the locking device to open the locking device of the locked state shown in FIGS. 5A and 5B, the motor 18 is rotated in a reverse direction. Then, the hook shaped plate spring 227 is retracted along the worm gear 183 to retract the tilting mechanism. In this case, the upper recess 221 of the tilting mechanism 22 is detached from the rotation stopper 125 of the housing, whereby the cylinder device cannot be rotated. In this state, if the key is rotated, the cylinder device is rotated and the locking plate is opened. FIG. 4 illustrates the state that the locking device is opened. In this case, the protrusion 325 formed at the stopper 32 adjoins the rotation stopper 125 of the housing so as not to rotate the cylinder device any longer.

INDUSTRIAL APPLICABILITY

The locking device of the present invention can widely be used for a locking device of an electrical door

The invention claimed is:

1. A locking device comprising:

a housing; and a cylinder device rotating within the housing, wherein the housing is provided with a protrusion therein to prevent the cylinder device from being rotated, and the cylinder device includes a motor, a cylinder receiving the motor, a tilting mechanism located at the front of the cylinder, having an upper portion tilted to be fixed to the protrusion of the housing by forward rotation of the motor and a recess released from the protrusion of the housing by reverse rotation of the motor, and a locking plate adapter fixed to the tilting mechanism, and a locking plate fixed to the adapter.

2. The locking device of claim 1, wherein the protrusion is formed in the housing and is non-rotating.

3. The locking device of claim 1, wherein the tilting mechanism is substantially a circular plate with recesses at upper and lower portions, and a hole at the center.

4. The locking device of claim 1, wherein the tilting mechanism has a hole at the center, and further includes a hook shaped plate spring disposed in the hole and fixed to the tilting mechanism.

5. The locking device of claim 4, wherein the motor further includes a worm gear to pass through the hole of the tilting mechanism and to engage the hook shaped plate spring.

* * * * *